US009506644B2

(12) United States Patent
Liu

(10) Patent No.: US 9,506,644 B2
(45) Date of Patent: Nov. 29, 2016

(54) CEILING FAN LIGHTING SYSTEM

(71) Applicant: Ching-Wen Liu, Taichung (TW)

(72) Inventor: Ching-Wen Liu, Taichung (TW)

(73) Assignee: PAN AIR ELECTRIC CO., LTD., Taichung (TW)

( * ) Notice: Subject to any disclaimer, the term of this patent is extended or adjusted under 35 U.S.C. 154(b) by 347 days.

(21) Appl. No.: 14/225,431

(22) Filed: Mar. 26, 2014

(65) Prior Publication Data

US 2015/0276207 A1 Oct. 1, 2015

(51) Int. Cl.
*F21V 33/00* (2006.01)
*F21S 8/04* (2006.01)

(52) U.S. Cl.
CPC ..... *F21V 33/0096* (2013.01); *F21S 8/04* (2013.01)

(58) Field of Classification Search
CPC ..... F21V 33/0096; F21V 33/00; F04D 29/36
USPC ..... 416/5; 362/285, 371, 372
See application file for complete search history.

(56) References Cited

U.S. PATENT DOCUMENTS

2008/0193291 A1* 8/2008 Ware ..... F04D 29/601 416/5
2014/0241881 A1* 8/2014 Villella ..... F04D 25/08 416/5

* cited by examiner

*Primary Examiner* — Kevin Lee
(74) *Attorney, Agent, or Firm* — Guice Patents PLLC

(57) ABSTRACT

A ceiling fan lighting system includes a fan assembly, a light assembly and a lift mechanism. The fan assembly includes a motor and a plurality of fan blades being operationally coupled to the motor to permit rotation of the fan blades when the motor is supplied with power. The light assembly is coupled to the fan assembly and has at least one light source and a lamp shade enclosing the light source. Moreover, the lift mechanism is configured to move the light assembly in a vertical plane with respect to the fan assembly in order to have the lamp shade of the light assembly enclose or disclose the fan blades of the fan assembly.

7 Claims, 6 Drawing Sheets

CEILING FAN LIGHTING SYSTEM

BACKGROUND OF THE INVENTION

1. Field of the Invention

The present invention relates to a ceiling fan lighting system, and more particularly to a ceiling fan lighting system having a lamp shade movable to cover fan blades of the system from view when the fan blades are not in use.

2. Description of the Related Art

Ceiling fans having a number of motorized rotating blades have existed for many years. Many of today's ceiling fans include a light assembly which may be used in the place of a light fixture mounted to the ceiling. The light assembly typically is mounted to the bottom of the ceiling fan below the plane of rotation of the fan blades.

However, while in use, not both the light assembly and the fan assembly are utilized at the same time. In summer, it is desire to simply use the fan assembly without using the light assembly during the daytime. The light assembly is idle and contributes no good to the fan assembly by interrupting the airflow produced by the fan assembly. In contrast, in the case where the fan assembly is not in use, such as in winter, the fan assembly can be deemed as a waste of space.

SUMMARY OF THE INVENTION

The present invention solves the problems presented above by generally comprising a fan assembly, a light assembly and a lift mechanism. The fan assembly includes a motor and a plurality of fan blades being operationally coupled to the motor to permit rotation of the fan blades when the motor is supplied with power. The light assembly is coupled to the fan assembly and has at least one light source and a lamp shade enclosing the light source. The lift mechanism is configured to move the light assembly in a vertical plane with respect to the fan assembly in order to have the lamp shade of the light assembly enclose or disclose the fan blades of the fan assembly. In this manner, when the fan assembly is not in use, such as in winter, the light assembly may be lifted upward to have its lamp shape disguise the fan assembly, especially the fan blades.

Further benefits and advantages of the present invention will become apparent after a careful reading of the detailed description with appropriate reference to the accompanying drawings.

DETAILED DESCRIPTION OF EMBODIMENTS

Figure 1:
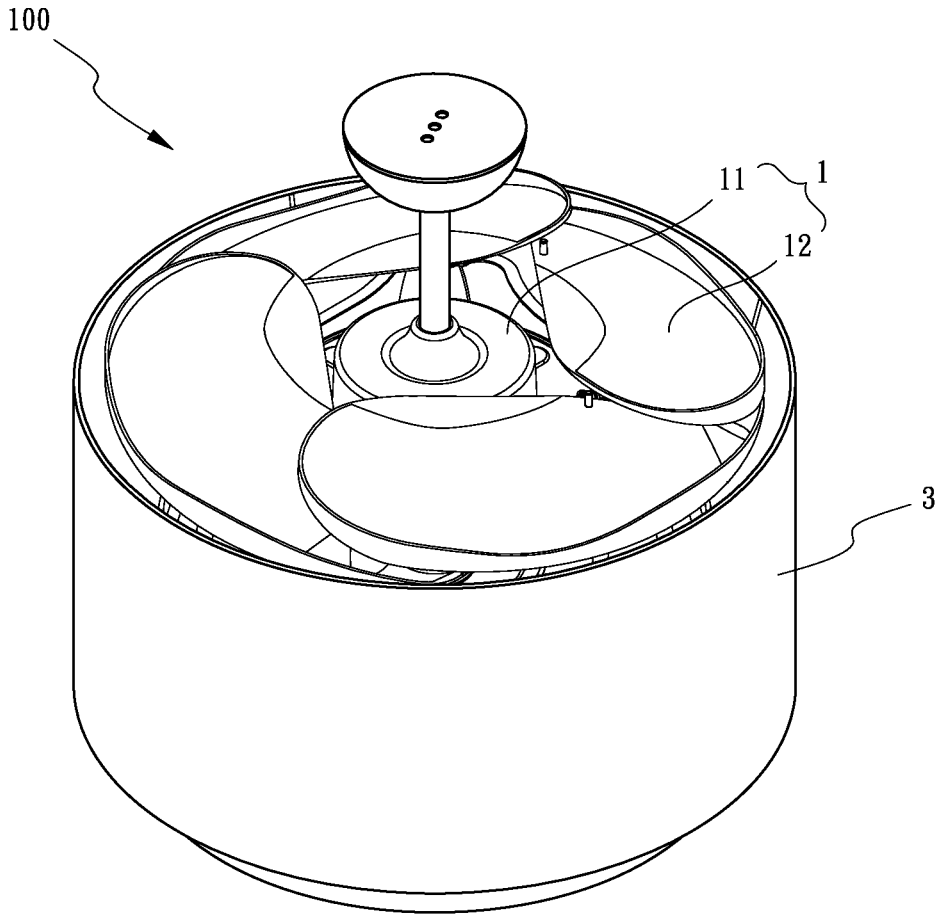
FIG. 1 is a perspective view of a ceiling fan lighting system in accordance with the preferred embodiment of the present invention.
Figure 2:
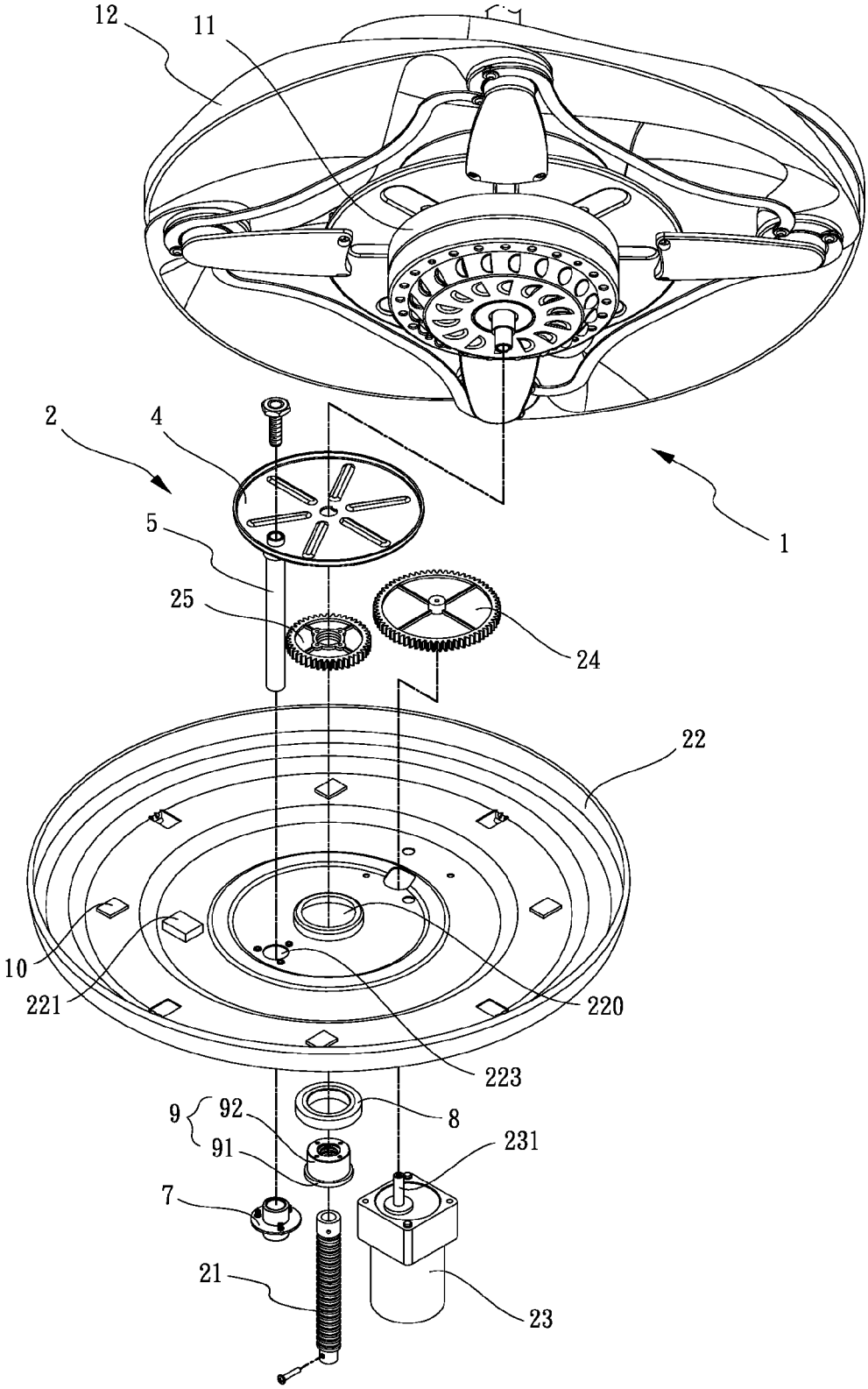
FIG. 2 is a partial exploded perspective view of the system in FIG. 1.
Figure 3:
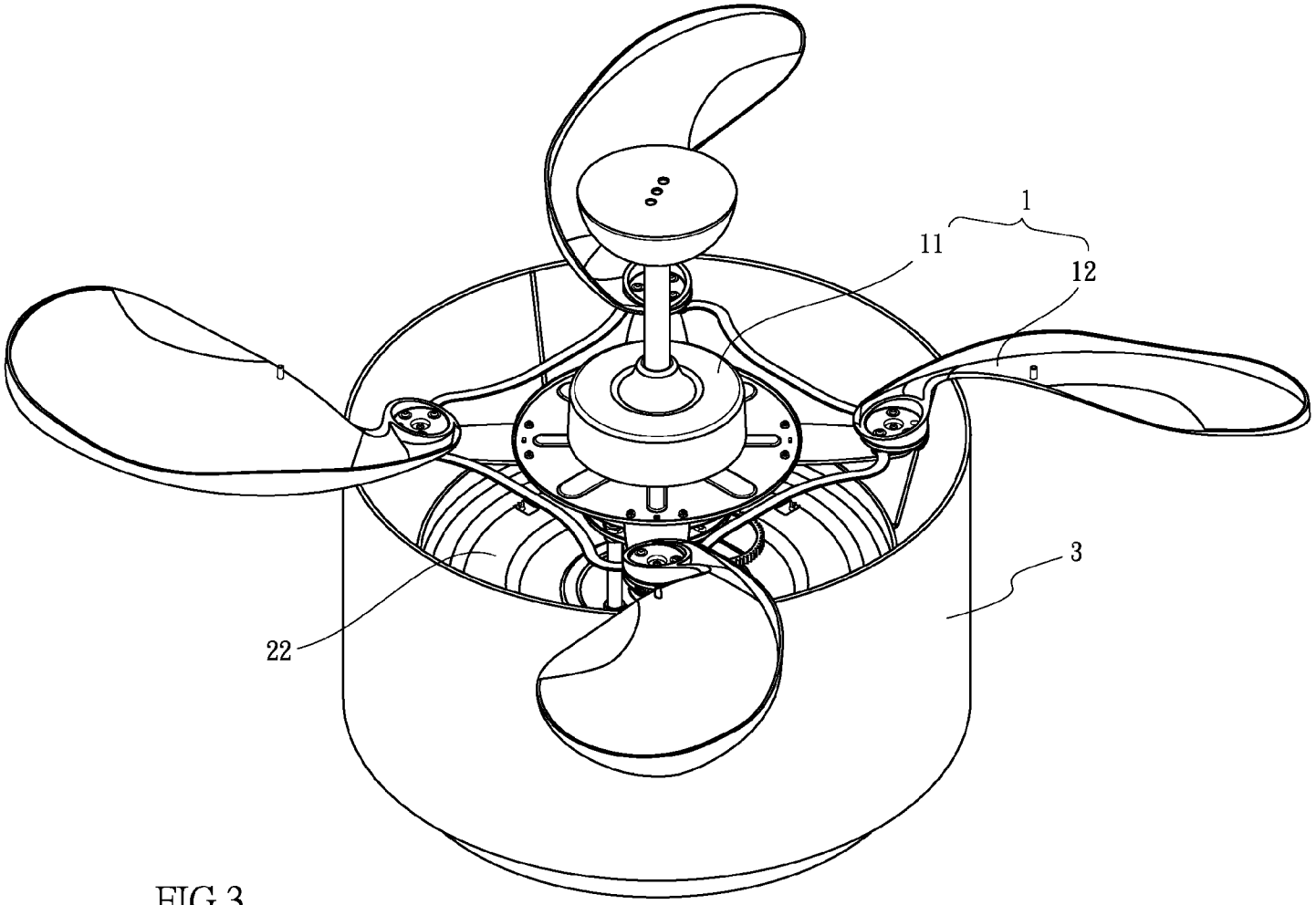
FIG. 3 is another, perspective view of the system shown in FIG. 1, showing the fan blades are in an extended state.

With reference now to the drawings, and in particular to FIGS. 1 through 3 thereof, a new ceiling fan lighting system embodying the principles and concepts of the present invention and generally designated by the reference numeral 100 will be described.

As best illustrated in FIGS. 1 through 3, the ceiling fan lighting system 100 generally comprises a fan assembly 1, a lift mechanism 2 and a light assembly (not numbered) having at least one light source 222 (FIG. 4), an electronic control device 221 and a lamp shape 3 enclosing the light source 222.

The fan assembly 1 is an electric fan which generally includes a motor 11 and a plurality of fan blades 12 operationally coupled to the motor 11 to permit rotation of the fan blades 12 when the motor 11 is supplied with power. Rotational motion produced by the motor 11 will produce air circulation through rotational movement of the fan blades 12. The light assembly is generally mounted to the bottom of the fan assembly 1. The lift mechanism 2 is configured to move the light assembly in a vertical plane with respect to the fan assembly 1, as illustrated in FIGS. 5 and 6, in order to have the lamp shade 3 of the light assembly enclose or disclose the fan blades 12 of the fan assembly 1.

Specifically, as shown in FIG. 2, the lift mechanism 2 includes a lead screw 21, a bracket 22, a motor 23, an internally-threaded shaft collar 9 and a micro motion controller 10. The bracket 22 is generally annular plate and is attached to the lead screw 21 to move in the vertical plane responsive to rotation of the shaft collar 9 about the lead screw 21. On the bracket 22 are the light source 222, the electronic control device 221, and the lamp shape 3 of the light assembly. The electronic control device 221 is connected to the light source 222 for control a state of the light source 222. The motor 23 is configured to drive the rotation of the lead screw 21, thereby resulting in upward or downward movement of the bracket 22. That is, the rotation of the lead screw 21 by the motor 23 raises or lowers the bracket 22 as well as the light source 222 and the lamp shape 3 all together relative to the fan assembly 1, as illustrated in FIGS. 5 and 6. The micro motion controller 10 is disposed on the bracket 22 and connected to the motor 23 for control a state of the motor 23.

More specifically, as shown in FIG. 2, the lift mechanism 2 further includes a first gear 24 and a second gear 25. The first gear 24 is positioned above the bracket 22 and is meshed with a drive shaft 231 of the motor 23, which extends through the bracket 22 and positioned on a top surface of the bracket 22. The second gear 25 meshes with the first gear 24 and is positioned about the lead screw 21 and above the bracket 22. The shaft collar 9 has a head 91 positioned below the bracket 22 and a shank 92 extending from the head through a central hole 220 of the bracket 22 to engage the second gear 25. Thus, the shaft collar 9 can rotate with the second gear 25 simultaneously around the lead screw 21. The bracket 22 is positioned between the second gear 25 and the head 91 of the shaft collar 9. Preferably, a gasket 8 is mounted around the lead screw 21 and positioned in between the bracket 2 and the head 91 of the shaft collar 9. In other words, the shaft collar 9 incorporates with the second gear 24 to hold the bracket 22 to move vertically along the lead screw 21. In operation, rotation of the drive shaft 231 of the motor 23 drives the first gear 24 to rotate, which in turn drives the second gear 25 together with the lower shaft collar 9 to rotate around the lead screw 21, thereby raising or lower the bracket 22 and the light assembly with respect to the fan assembly 1.

Figure 4:
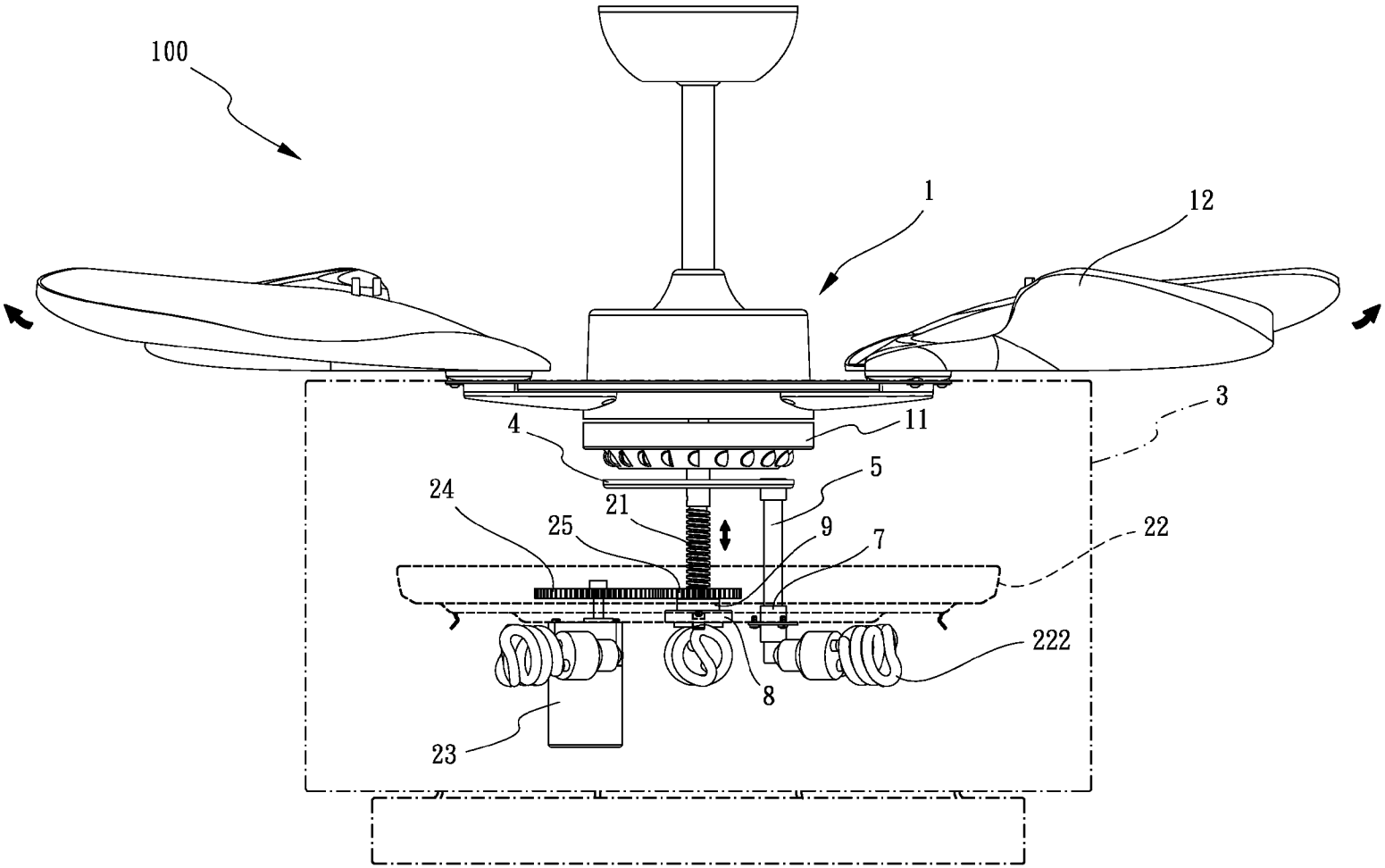
FIG. 4 is a side view of the system shown in FIG. 3.
Figure 5:
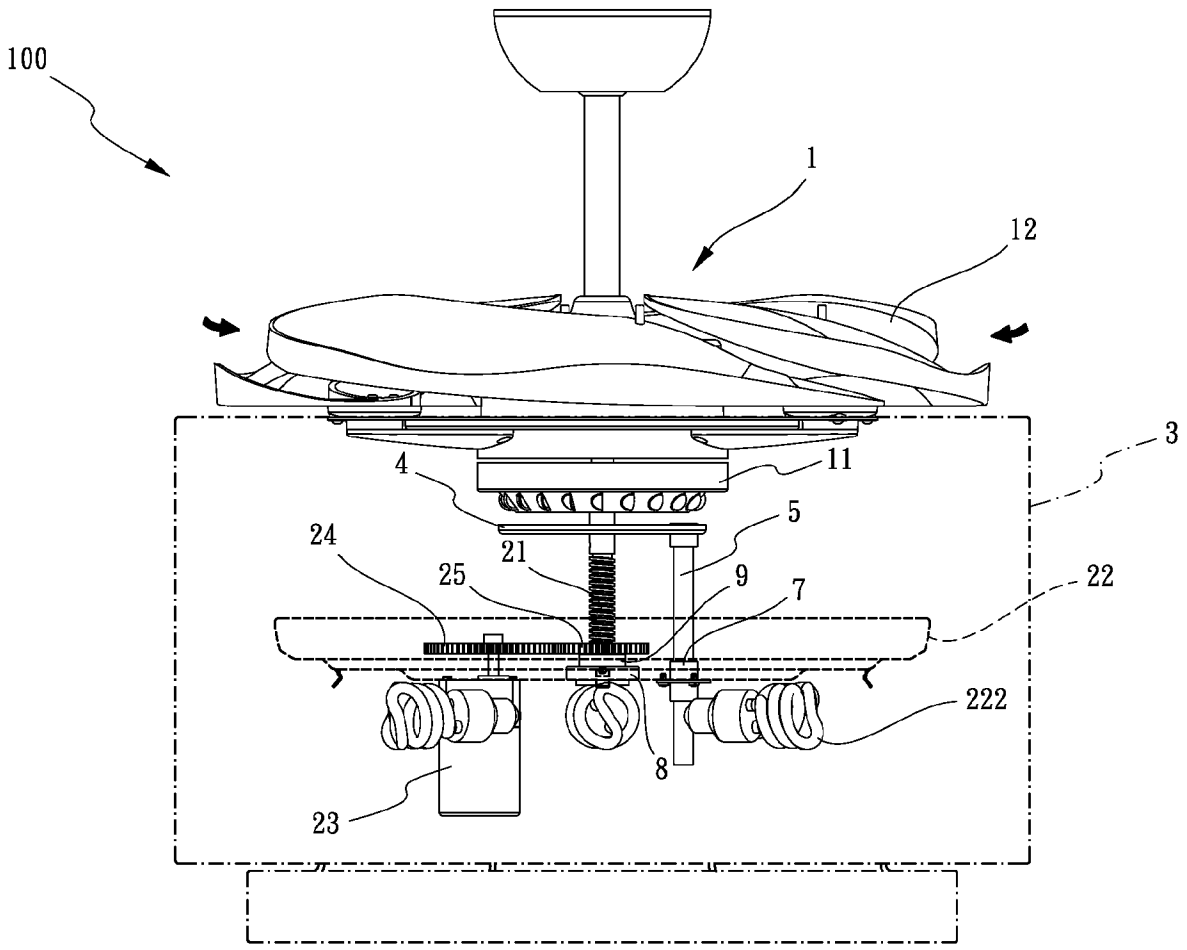
FIG. 5 is a view similar to FIG. 4, showing the fan blades are retracted.
Figure 6:
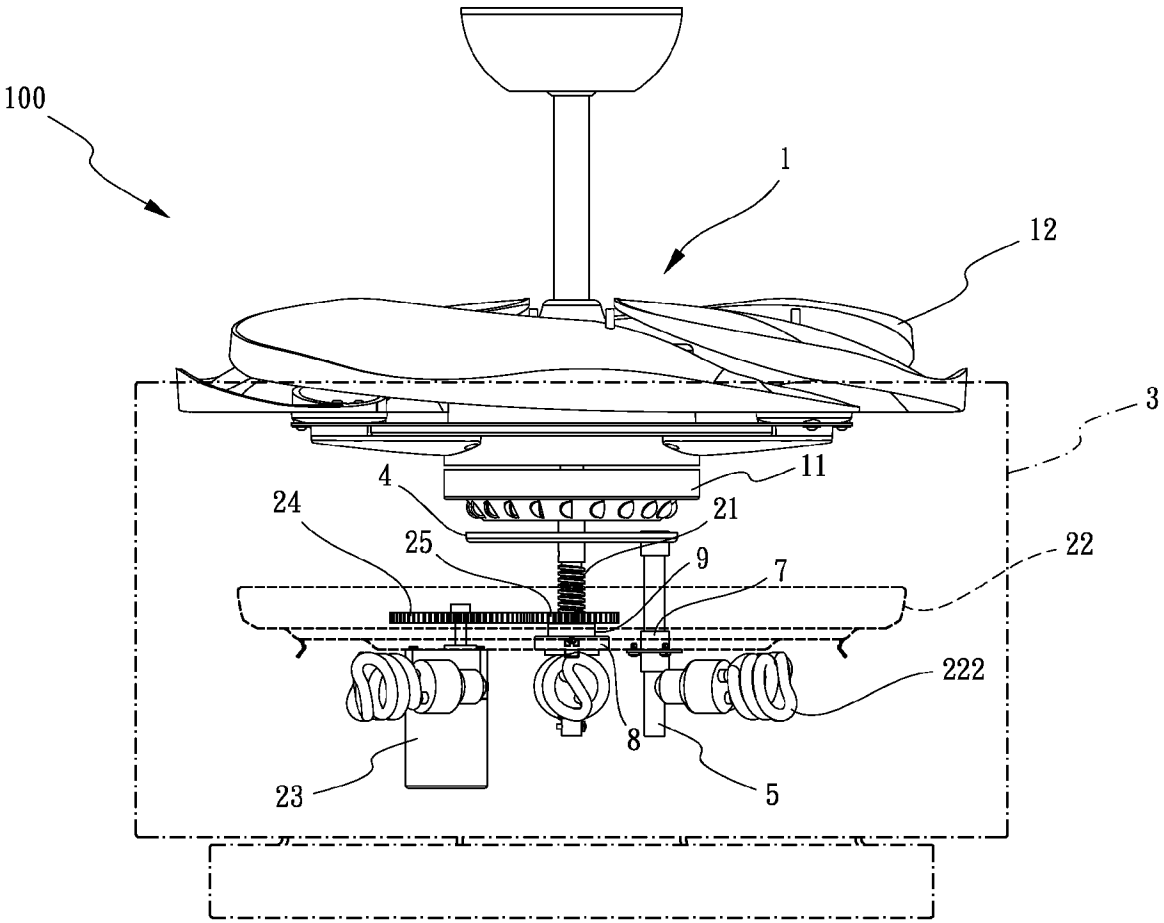
FIG. 6 is a side view of the system shown in FIG. 1, showing the light assembly is lifted to an upper position.

As shown in FIGS. 4 and 5, the fan blades 12 of the fan assembly 1 are retractable. Once the fan blades 12 are in its fully retracted state, as depicted in FIG. 5, the light source 222 and the lamp shade 3 of the light assembly are permitted to be lifted up by the lift mechanism 2 to have the lamp shape 3 enclose the retracted fan blades 12, as illustrated in FIG. 6. The fan assembly 1 is shown in the preferred embodiment with retractable fan blades 12; however, non-retractable, smaller fan blades may be used as dictated by convention.

Furthermore, a positioning assembly (not numbered) may be employed to provide stability of the movement of the fan assembly, which generally includes a positioning plate 4 and a positioning post 5. As shown in FIG. 4, the positioning plate 4 is parallel to the bracket 22 and is mounted to a bottom of the fan assembly 1. The positioning post 5 is parallel to the lead screw 21, and has an upper end secured to the positioning plate 4 and a lower end inserted through a bore 223 of the bracket 22 such that the bracket 22 is confined to move along the positioning post 5 and the lead screw 21.

It is to be understood that the disclosed embodiments are illustrative in nature and the invention is not to be limited to any one or more embodiments except as set forth in the following claims.

What is claimed is:

1. A ceiling fan lighting system, comprising:

a fan assembly including a motor and a plurality of fan blades being operationally coupled to the motor to permit rotation of the fan blades when the motor is supplied with power, the fan blades of the fan assembly being retractable;

a light assembly coupled to the fan assembly and having at least one light source and a lamp shade enclosing the light source; and a lift mechanism configured to move the light assembly in a vertical plane with respect to the fan assembly when the fan blades are in a fully retracted state so as to have the lamp shade of the light assembly enclose or disclose the fan blades of the fan assembly.

2. The ceiling fan lighting system as recited in claim 1, wherein the lift mechanism includes:

a lead screw;

an internally-threaded shaft collar mounted around the lead screw;

a bracket on which the light source and the lamp shape are mounted, the bracket being carried by the shaft collar and configured to move in the vertical plane responsive to rotation of the shaft collar around the lead screw; and a motor configured to drive rotation of the shaft collar around the lead screw.

3. The ceiling fan lighting system as recited in claim 2, wherein the lift mechanism further includes:

a first gear positioned above the bracket and meshed with a drive shaft of the motor of the lift mechanism; and a second gear meshed with the first gear, and positioned about the lead screw and above the bracket;

the shaft collar having a head positioned below the bracket and a shank extending through the bracket to engage with the second gear such that the bracket is positioned between the second gear and the head of the shaft collar;

wherein rotation of the drive shaft of the motor drives the first gear to rotate, which in turn drives the second gear together with the shaft collar to rotate about the lead screw, thereby raising or lowering the bracket and the light assembly.

4. The ceiling fan lighting system as recited in claim 3, the lift mechanism further includes a gasket mounted around the lead screw and positioned in between the bracket and the head of the shaft collar.

5. The ceiling fan lighting system as recited in claim 3, further comprising a positioning assembly which includes:

a positioning plate generally parallel to the bracket and mounted to a bottom of the fan assembly; and a positioning post generally parallel to the lead screw, and having an upper end secured to the positioning plate and a lower end inserted through a bore of the bracket such that the bracket is confined to move along the positioning post as well as the lead screw.

6. The ceiling fan lighting system as recited in claim 3, wherein the lift mechanism further includes a micro motion controller disposed on the bracket and connected to the motor of the lift mechanism for control a state of the motor.

7. The ceiling fan lighting system as recited in claim 2, wherein the light assembly further includes an electronic control device disposed on the bracket and connected to the light source for control a state of the light source.

* * * * *